United States Patent [19]

Eisermann

[11] Patent Number: 4,918,957

[45] Date of Patent: Apr. 24, 1990

[54] LOCK WITH LOCKING FUNCTION RELEASED BY INSERTION OF A CODED CARD

[76] Inventor: Armin Eisermann, Eichholzstrasse 14, D-5620 Velbert 1, Fed. Rep. of Germany

[21] Appl. No.: 224,073

[22] Filed: Jul. 25, 1988

[30] Foreign Application Priority Data

Jul. 25, 1987 [DE] Fed. Rep. of Germany ..... 3724711
Jul. 25, 1987 [DE] Fed. Rep. of Germany ..... 3724710

[51] Int. Cl.[5] ..... E05B 47/00

[52] U.S. Cl. ..... 70/276; 70/413; 70/DIG. 41

[58] Field of Search ..... 70/DIG. 41, 276, 413; 192/89 B, 93 R; 194/248

[56] References Cited

U.S. PATENT DOCUMENTS

| | | | |
|---|---|---|---|
| 3,015,087 | 12/1961 | O'Gorman | 70/276 X |
| 3,605,459 | 9/1971 | Van Dalen | 70/413 X |
| 3,611,763 | 10/1971 | Sedley | 70/276 X |
| 3,995,460 | 12/1976 | Sedley | 70/413 X |
| 4,133,194 | 1/1979 | Sedley et al. | 70/276 X |
| 4,312,198 | 1/1982 | Sedley | 70/276 |
| 4,572,348 | 2/1986 | Eisermann et al. | 70/DIG. 41 X |
| 4,644,766 | 2/1987 | Lovell | 70/276 |
| 4,649,725 | 3/1987 | Yamashita | 70/413 X |
| 4,676,083 | 6/1987 | Sedley et al. | 70/413 X |

*Primary Examiner*—Robert L. Wolfe
*Assistant Examiner*—Suzanne L. Dino

[57] ABSTRACT

There is provided a lock with a locking function of a bolt to be released by the inserting of a coded card scanned in the lock, and carried out by means of a key, in particular for use in safety deposit boxes or compartments of public swimming pools or the like with an outwardly open card insertion shaft on the casing of the lock. For the purpose of obtaining a lock design that is easy to use and that excludes operating errors and which is safely protected against misuse, a locking repeat barrier is utilized that is associated with the bolt and actuated by the locking movement of the bolt even with the card inserted in the lock.

10 Claims, 7 Drawing Sheets

LOCK WITH LOCKING FUNCTION RELEASED BY INSERTION OF A CODED CARD

The present invention relates to a lock having a bolt locking function released by inserting a coded, scanned card and carried out by means of a key. The lock has an outwardly open card insertion shaft on the casing thereof.

A lock of the type with which the present invention is concerned is disclosed in U.S. Pat. No. 4,572,348, to Eisermann et al., granted Feb. 25, 1986, wherein the bolt of the lock is moved into its locking position by means of a key after a coded card has been inserted in the card insertion shaft. Thereafter, with the bolt in the locked position, the key can be removed, whereas the card remains in the lock, which is disposed on the inside of the safety deposit box, or locker. The card is such that when the bolt is moved into its locking position, a card-scanning magnetic pin exits from its position blocking movement of the bolt into its locking position. Such a lock permits the user of a locker to move the bolt again into its locking position after it has been returned to its nonlocking position. This has the drawback that after the user has completed using the locker, such user may, out of thoughtlessness or ignorance, move the bolt into its locking position with the door of the locker open or closed, and take out the key in order to pass the exit barrier with such key. As the card is required for passing the exit barrier, however, this leads to problems with the operation of a public swimming pool facility that is equipped with such locks. If the bolt of the lock has been moved into its locking position without the door of the safety box being in the position in which it can be locked, the coded card may have been removed by someone in the meantime. Furthermore, this lock design permits unauthorized manipulations, particularly if such coded cards are made from a thinner, tearable material.

The object of the present invention is to provide a lock of the type described above that is designed so that it is safe against misuse and easy to use in a way such that operating mistakes are excluded for the most part.

The above object is accomplished in accordance with the present invention by a lock of the type outlined above that has a higher intrinsic value. As opposed to the state of the art, any movement of the bolt into its locking position, i.e. into the position in which the key can be pulled out, constitutes the first locking step after the card has been inserted. In practical application, this means that the bolt of the lock cannot be moved into its locking position without inserting the card. Once the card has been inserted, the bolt can be moved into the locking position and the key can be removed, in order to use, for example, the pool of a public swimming pool facility. When the user returns to the locker, he can move the bolt into the open position by means of the key. However, he cannot thereafter move the key again into its locking position because when the bolt is moved into its locking position the first time, a locking repeat barrier function was released and activated. This alerts the user to the fact that he must remove the card from the card insertion shaft, which means there is never any risk that the user, by mistake, takes the key with him after locking the locker, and that such user may want to leave the public facility or the like with the key. Furthermore, this locking repeat barrier function usefully takes into account the fact that people are accustomed to the widely used deposit locks, in connection with which a coin is returned to the user after the bolt of the lock has been returned into the lock-open position. With such locks, too, another coin must be deposited in the lock if the locker is to be locked again by moving the bolt into the locking position.

Contrary to the state of the art, the card insertion shaft is disposed on a slide, which is displaceable together with the locking movement of the bolt. This slide supports the cam of a supplementary slide, which is spring-loaded against the direction in which the card is inserted, such cam being displaceable by the leading or forward edge of the card. Accordingly, the spring loading the supplementary slide is tensioned as the card is inserted in the card insertion shaft. As the bolt is moved into its locking position, the slide is carried along, during which movement the cam is controlled in such a way that it moves from its stop position on the edge of the card. The supplementary slide with the cam is pulled back by the spring and the cam rests against the corresponding wide surface of the card. Simultaneously, the function of the bolt locking repeat barrier has been released and put into action by the supplementary slide, and another locking movement of the bolt is no longer possible because the supplementary slide now assumes another position. The card must be removed rather and inserted again, so that the cam is acted upon while the supplementary slide is displaced forwardly. This control element is designed in the form of a control finger in a way such that when the card is inserted and the cam is displaced together with the supplementary slide, the control finger is disposed in front of the feed lock pawl associated with the bolt, and ready to be lifted out. When the bolt is moved into its locking position, the supplementary slide with the control finger is carried along via the slide and the control finger lifts the lock pawl into a release position relative to the bolt, which permits moving the latter completely into its locking position. If no properly coded card was inserted, no displacement of the supplementary slide with the control finger can take place, so that if an attempt is made to move the bolt into the locking position, the lock pawl moves into a blocking position relative to the bolt.

This design of the lock, furthermore, permits a coin release control for the locking function that is connected in parallel with the card release control. If, for example, the card operation in a public bathing facility breaks down and fails, such facility can be operated with the use of coins, in which case no card has to be inserted for locking the locker with the bolt. After a coin has been inserted, the edge of such coin, in the initial phase of the locking movement, lifts the lock pawl into the release position, and permits complete locking of the bolt, i.e., to be completely moved into its final locking position. Such a design, moreover, permits using a coded card for other services. Thus, when the card is removed from the lock, the bolt can be nevertheless moved into its locking position after inserting a coin, in order to safeguard the property deposited in the locker. This function is not impaired by the slide, which is spring-loaded against its locking movement, and the components cooperating with such slide.

When using the proper card and moving the bolt into its locking position while simultaneously carrying along the slide, the card-scanning magnetic pin, which is moveable transversely relative to its direction of displacement, is controlled in such a way that it will not interfere with the forward displacement of the slide and thus of the bolt. If, however, the wrong card is used, the card-scanning magnetic pin moves into a blocking position and blocks the proper locking of the safety box or compartment. As mentioned above, the cam starts to be controlled after a certain locking distance or path has been passed. Such control of the cam is accomplished in a simple manner in that the cam sits on the free end of a rocker supported in the slide, the rocker being spring-loaded on the cam slide by a pressure spring in the direction of the card insertion shaft. This rocker is a part of the supplementary slide. However, a swinging motion of the rocker is not transmitted to the other part of the supplementary slide. Accordingly, by releasing the cam, the rocker performs a superimposed swinging and sliding motion. The fact that the card insertion shaft is now disposed on a moving part of the lock, i.e., on the slide that is displaceable together with the locking movement of the bolt, contributes to the safe design of the lock, which is safely protected against tampering.

After inserting the coded card in the card insertion shaft and subsequently moving the lock bolt into the locking position, the slide is displaced at the same time, so that after the bolt has been moved into its locking position completely, the trailing edge of the card is in a hidden position and inaccessible. This means that no unauthorized manipulations are possible with the door of the locker open, for example, removal of the card after the bolt has been moved into the locking position. Thus, no interference with the operation of the public bathing facility is possible in this way and it is never possible to be in possession of the key with the card after the bolt has been moved into the locking position, because the key is either inserted into the lock and the user has the card, or the card is in an inaccessible position in the lock and the key is removed from the lock.

As the card, after it has been inserted in the pocket of the slide, is supported within the zone of all of its edges, it is safely carried along into the hidden position when the bolt is moved into its locking position. The projecting lateral shoulders protruding over the card as it is being inserted are the elements that carry along the card as the bolt is being moved into the locking position. When the slide is in the return position, which conforms with the position in which the bolt is moved into unlocked or open position, the end of the slide on the insertion side is in a position covering the recess of the face wall of the lock, which measure facilitates the insertion of the card in the card insertion shaft. Furthermore, the design of the lock is such that the bolt can be moved into its locking position either on insertion of the card or after inserting a coin. If, for example, cards cannot be given out in a public bathing facility for some reason, the locking function normally performed by a card issued against a deposit can be assumed by coins while using the safety deposit boxes in a public bathing facility, or the card can be used within the facility for other services after the box has been locked by means of a coin.

Other objects and features of the present invention will become apparent from the following detailed description considered in connection with the accompanying drawings. It is to be understood, however, that the drawings are designed as an illustration only and not as a definition of the limits of the invention. In the drawings, wherein similar reference characters denote similar elements throughout the several views.

Figure 1:
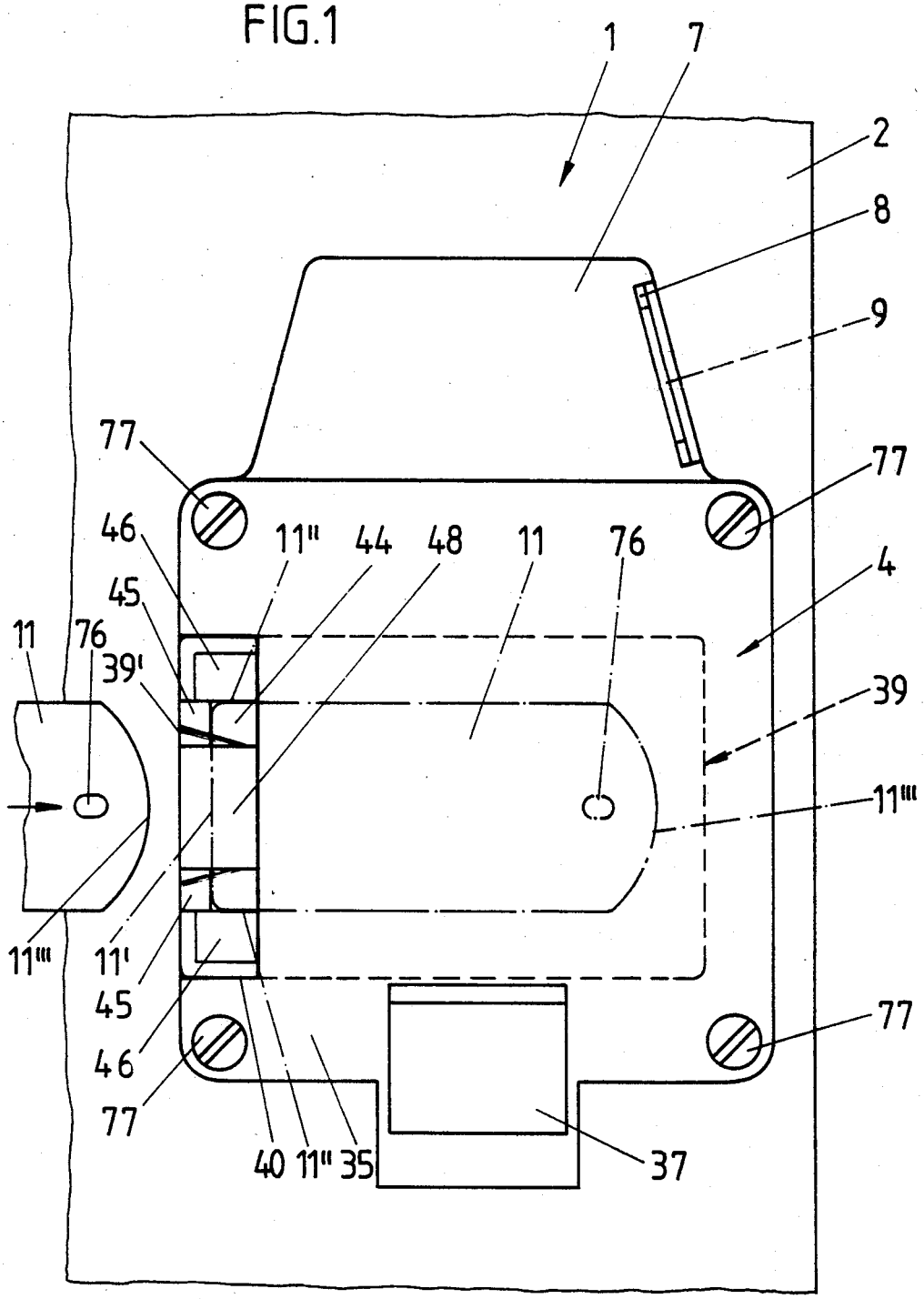
FIG. 1 is a view of a lock according to the present invention with the bolt in the unlocked position, the lock being mounted on the inside surface of a safety deposit box door.
Figure 2:
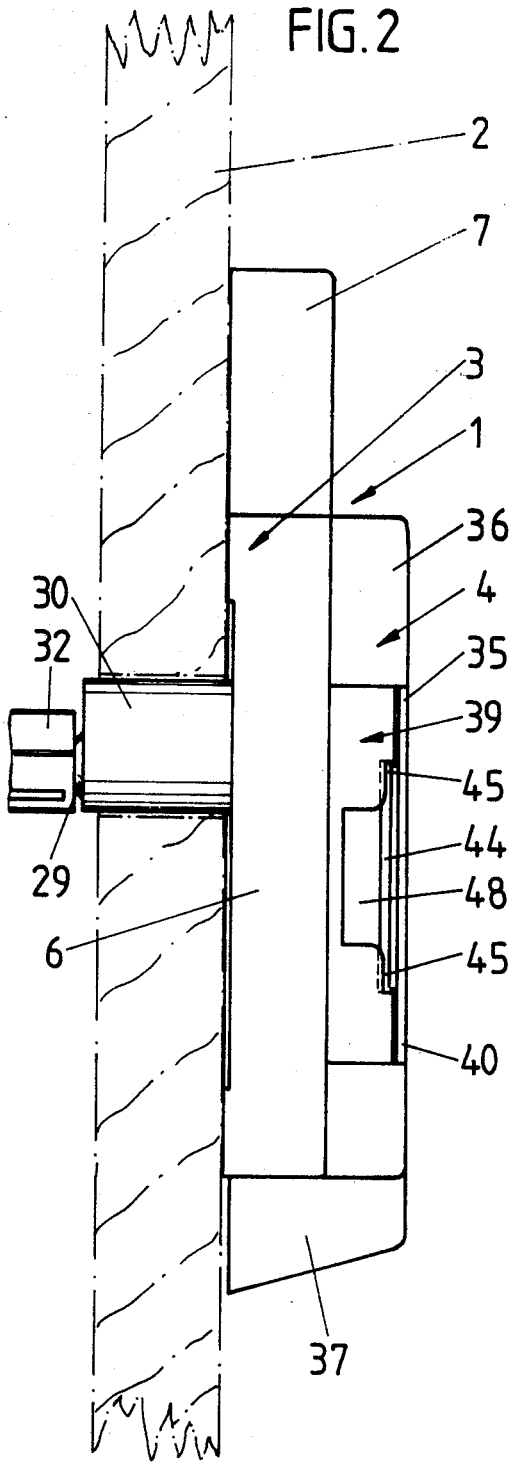
FIG. 2 is a view of the lock according to FIG. 1 in the direction of the card insertion shaft.
Figure 7:
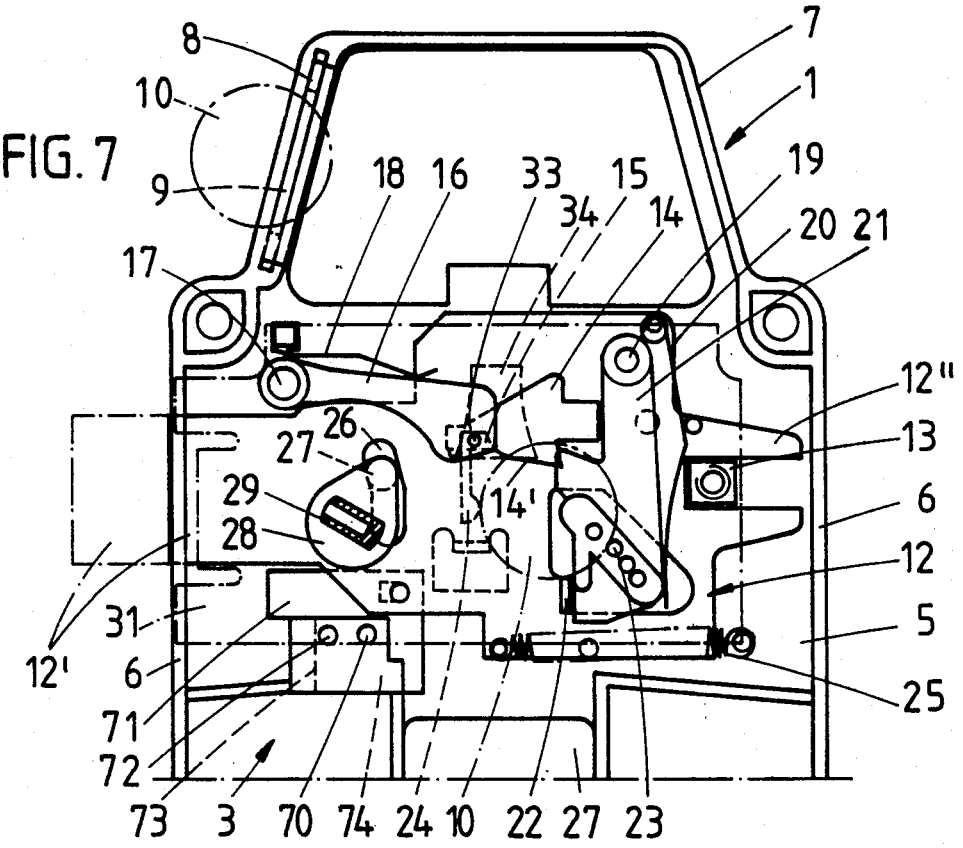
FIG. 7 is a view of the parts accommodated in the box of the lock corresponding with the bolt in the unlocked position.

Now turning to the drawings, therein is shown a lock 1 fastened on the interior surface of a door 2 of a safety deposit box. In detail, lock 1 has a lock box 3, which is directly mounted on the door 2, or resting against the latter, and an attachment casing 4 associated with box 3. Lateral walls 6 of the lock box extend from bottom 5 of the lock box at right angles. Within the upper zone, lock box 3 continues to extend into a casing zone 7, which is narrower than box 3, and which has a coin plate 8 with a calibrated insertion slot 9 for a deposit coin 10 (FIG. 7). In addition to being actuated by means of such coin, the lock can be bolted also by means of a coded card 11 (FIG. 1).

A horizontally displaceable bolt 12 is guided in lock box 3. The head 12' of such bolt penetrates the one lateral wall 6 of the lock box, whereas the rear end 12'' of the bolt is guided on a square lug 13 on the side of the lock box. Within its upper zone, end 12'' of the bolt contains a shaped locking recess 14, into which projects a locking tooth 15 of a single-arm feed lock pawl 16, the locking tooth extending up to the bottom 5. Bearing pin 17 of locking pawl 16 extends from the bottom 5 and beyond the head 12' of the bolt. A leaf spring 18 loads locking pawl 16 clockwise in such a way that its locking tooth 15 supports itself on toothed bottom edge 14' of locking recess 14.

On the side averted from bottom 5, end 12'' of the bolt supports around a pin 19 a single-arm rocker 21, which is loaded clockwise by a leaf spring 20. The rotation of rocker 21 is limited by a stop means 22 on the bolt side. Rocker 21 is the support of a supporting pin 23, which is displaceable and which extends to the bottom 5. Supporting pin 23 is opposed by a shoulder 24 of bolt 12. The spacing between shoulder 24 and supporting pin 23 is smaller than the diameter of coin 10, so that the coin 10 inserted in the lock is supported on bolt 12 as shown in FIG. 7 by the dash-dotted line, so it cannot fall through.

Figure 3:
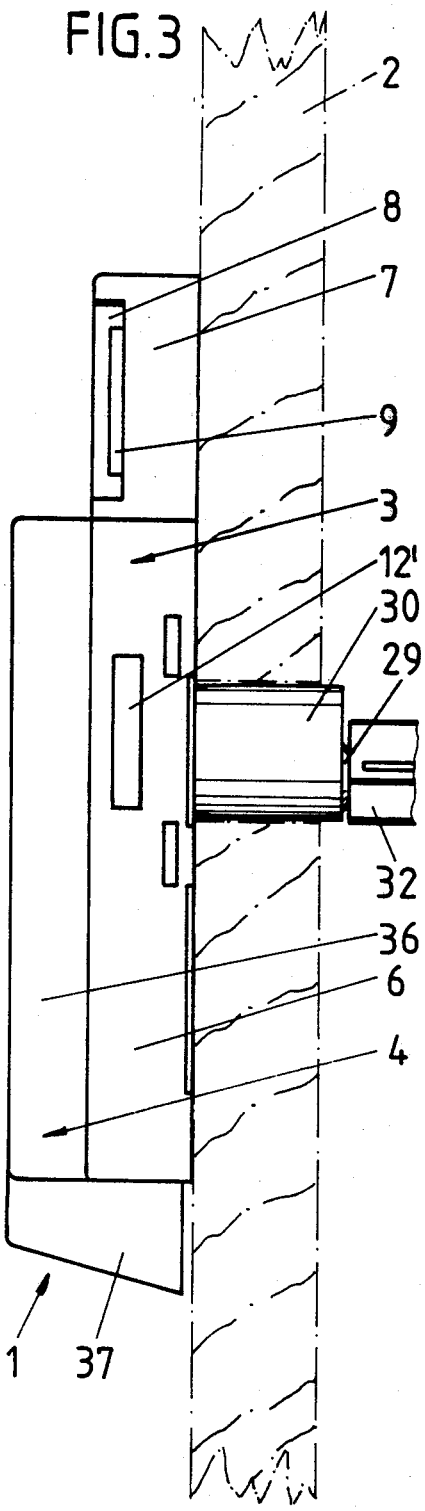
FIG. 3 is a view of the lock as seen from the side of the head of the bolt.

Bolt 12 is engaged by a tension spring 25, which is loaded in its basic position. Furthermore, bolt 12 is fitted with a slot 26 extending transversely relative to the direction of displacement of the bolt and which is engaged by a finger 27 of a crank arm 28. The latter is seated on the end of a cylinder core 29, which is flattened on both sides, and fixed thereon for rotating with the core. The cylinder core is rotatably arranged in a cylinder lock 30, which is fastened on a lock ceiling 31 indicated in FIG. 7 by a dash-dotted line, and which penetrates a bore of door 2. Cylinder core 29 is designed to receive a key 32 (FIG. 3) which cannot be removed or pulled out when bolt 12 is in its unlocked position.

Locking tooth 15 of lock pawl 16 serves as the support of a driving pin 33 extending through a recess 34 of lock box bottom 5 and projecting into attachment casing 4. The components of attachment casing 4 are a front wall 35 of the lock, of which the size corresponds or matches the size of lock box bottom 5, and casing walls 36, which extend from front wall 35 of the lock in the direction of lock box 3, and which are supported on lock box bottom 5. Bottom wall 36 of the casing continues to extend in the form of a coin return compartment 37, which is in connection with lock box 3. Lock 1 is mounted on door 2 by means of the fastening screws 77 which extend through attachment housing 4 and lock box 3 in the corner zones.

The attachment housing or casing 4 has a horizontally extending longitudinal recess 38 feeding into or ending in casing wall 36, the latter opposing head 12' of the bolt. A slide 39 is guided in said longitudinal recess 38, with its end 39' on the insertion side being, accordingly open towards corresponding casing wall 36. Within this zone, front wall 35 of the forms a recess 40, which in turn is disposed in such a way that it covers—or is aligned with—the end 39' of the slide 39 on the insertion side when such slide 39 is in its basic position, in which such slide 39 is supported by two pressure springs 41, which are arranged on both sides of the longitudinal center of the slide and supported on casing wall 36 disposed adjacent to the head 12' of the bolt. Furthermore, this basic position of the slide is limited by a stop means. For this purpose, two stop means 42 extend from the side of slide 39 facing front wall 35 of the lock, such stop means being supported on countershoulders 43 of front wall 35 of the lock. On the side forming stop means 42, slide 39 is provided with card insertion shaft 44, which is designed in the form of a pocket for receiving in a form-locked manner the card 11, supporting the latter within the zone of all of its edges. Support on the back edge 11' of the card is accomplished by the lateral shoulders 45, which run over the card when the latter is inserted in the shaft. Shoulders 45 are flanked by lateral guide strips 46 of slide 39 which support the lateral edges 11'' of the card. The leading edge 11''' of the card, which is rounded off, however, is associated with projection 47 of slide 39, such projection extending between stop means 42.

Within the zone of end 39' on the insertion side, card insertion shaft 44 continues to extend into a grip opening 48.

Figure 6:
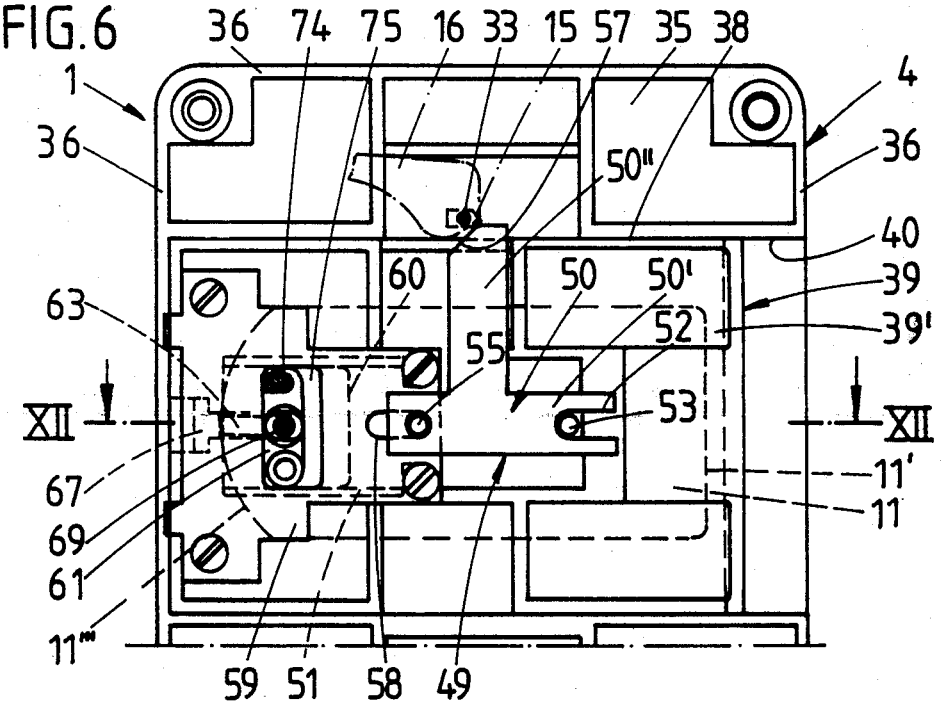
FIG. 6 is a view similar to FIG. 5, but with the bolt in the locking position and the slide carried along by the locking motion of the bolt.

On the side averted from card insertion shaft 44, slide 39 supports a supplementary slide 49 (FIG. 6), which consists of two slide parts 50 and 51. Slide part 50 is T-shaped in a way such that crossbeam 50' of the "T" is arranged movable in the horizontal direction relative to slide 39. For this purpose, T-crossbeam 50' has a guide slot 52, which is open on the edge side and engaged by a guide pin 53 on the side of the slide. The other end of T-crossbeam 50', however, has a bore 54 designed to be entered by coupling pin 55 of the other slide part 51. Coupling pin 55 is engaged by a tension spring 56 fixed on guide pin 53, which spring loads supplementary slide 49 against the direction in which slide 39 is advanced, or shifted in the forward direction. The T-bridge extending at right angles to T-crossbeam 50' forms a control finger 50'', which is provided with a bevel 57. Driving pin 33 of lock pawl 16 projects into the path of movement of such bevel 57.

Figure 8:
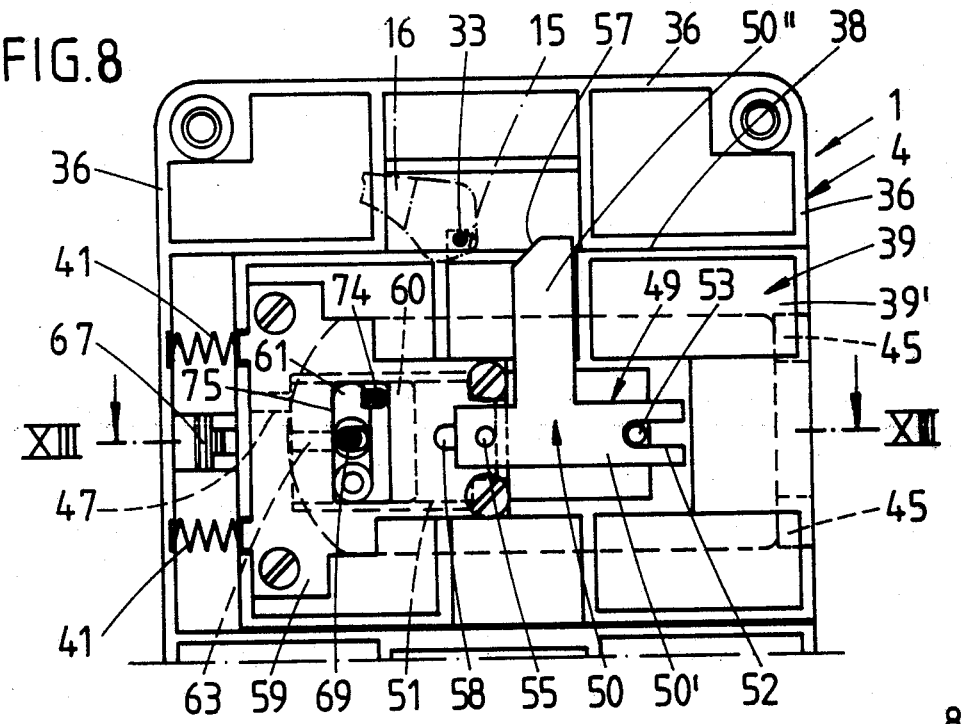
FIG. 8 is a view similar to FIG. 6, with the bolt in the unlocked position and the function of the locking repeat barrier released, or acting.
Figure 9:
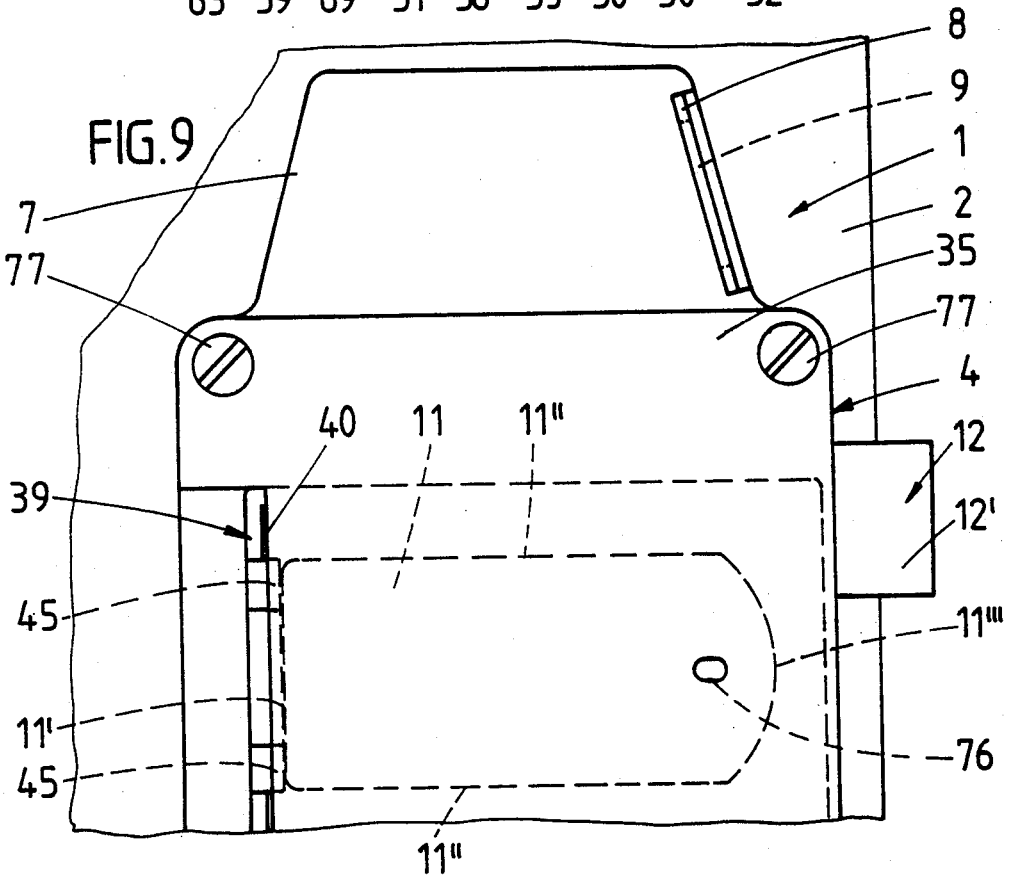
FIG. 9 is a view similar to FIG. 1, with the bolt in the locked position and the card in the hidden position.

As seen in FIG. 8, an oblong hole 58 extending in a slide cover 59 in the longitudinal direction of the slide serves for guiding the aforementioned coupling pin 55. Slide cover 59 extends beyond slide part 51, which is designed in the form of a rocker spring-loaded in the direction of card insertion shaft 44. Within the center zone, rocker 51 has a window 60, through which an oblong slide projection 61 extends. At the end opposing coupling pin 55, rocker 51 forms a cam 63, which extends through a longitudinal slot 62 of slide 39 and projects into card insertion shaft 44 and thus into the path in which the card is inserted. Longitudinal slot 62, furthermore, extends in the direction in which the slide is displaced, or in the direction of movement of the supplementary slide. The cam 63 has a blind-end bore 64 facing slide cover 59, in which bore the end of a pressure spring 65 immerses, such spring being supported at the other end on the inside surface of slide cover 59 and thus swings rocker 51 around coupling pin 55 forming the point of articulation, whereby cam 63 is displaced to such an extent that it immerses in a longitudinal groove 66 on the inside of front wall 35 of the lock. On corresponding wall 36 of the casing, the bottom of longitudinal groove 66 changes into a run-up bevel 67, which, accordingly, is disposed within the range of motion of cam 63. The height of run-up bevel 67 is such that cam 63 can be completely displaced from the plane of card insertion shaft 44.

Figure 10:
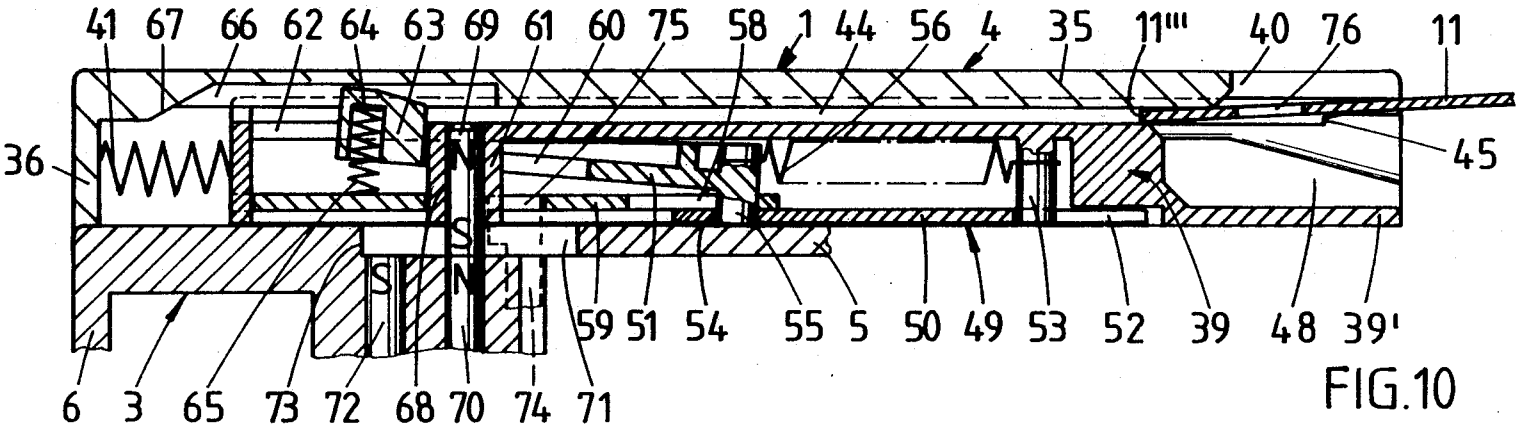
FIG. 10 is a cross-sectional view taken along line X—X of FIG. 4.
Figure 11:
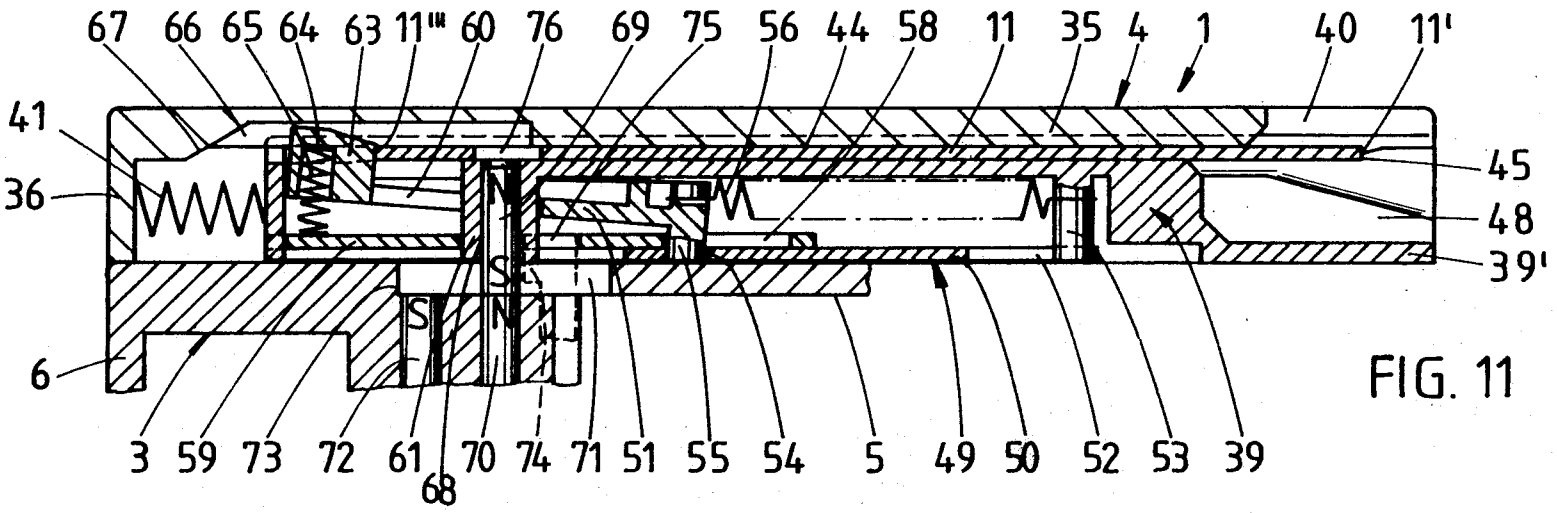
FIG. 11 is a cross-sectional view taken along line XI—XI of FIG. 5.

In the center, slide projection 61 has a through-extending bore 68 for receiving a card-scanning magnetic pin 69 (FIGS. 10 to 13), the latter being displaceable crosswise relative to the direction of displacement of slide 39. When slide 39 is in its basic position, a countermagnet 70, the latter being fastened in box 3 of the lock, extends opposite magnetic pin 69 in alignment with the latter, in a way such that magnetic pin 69 is pulled into a recess 71 of lock box bottom 5. When in this position, the other end of magnetic pin 69 is aligned flush with the wall of card insertion shaft 44 it is facing (see FIG. 10). In the bolt locking direction, pulling magnet 70 is facing a repelling magnet 72, whose face side is disposed on the same level as the face side of the pulling or attracting magnet 70 in a way such that when the slide 39 is displaced forwardly, magnetic pin 69 can smoothly travel up to repelling magnet 72. Following the latter, recess 71 changes into a blocking edge 73.

With its free end, slide projection 61 grips or extends through a window 75 of slide cover 59. A driver 74 extending from bolt 12 projects into window 75 in such a way that following a free amount of travel within window 75, such driver, during the movement of the bolt into its locking position, drives against the corresponding edge of the window and, in this way, drives slide 39 along. In the basic position, driver 74 prevents slide 39 from being displaced forwardly.

Figure 4:
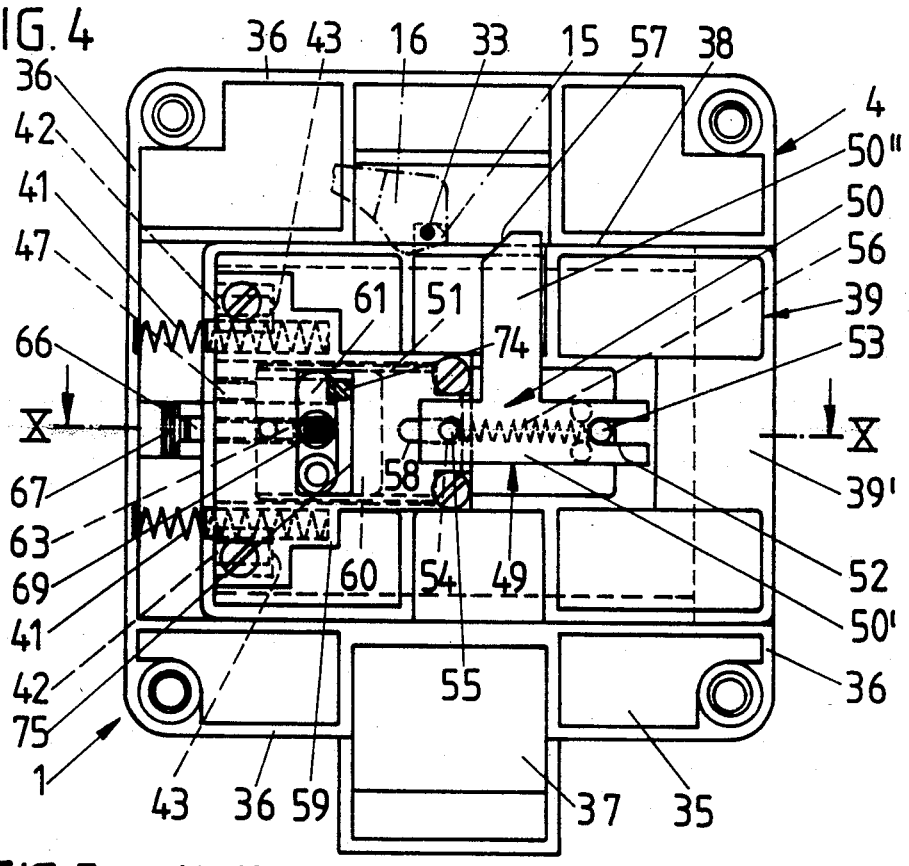
FIG. 4 is a view of the interior of the attachment casing accommodating the slide and the supplementary slide, the latter elements being in positions conforming with the unlocked position of the bolt.
Figure 5:
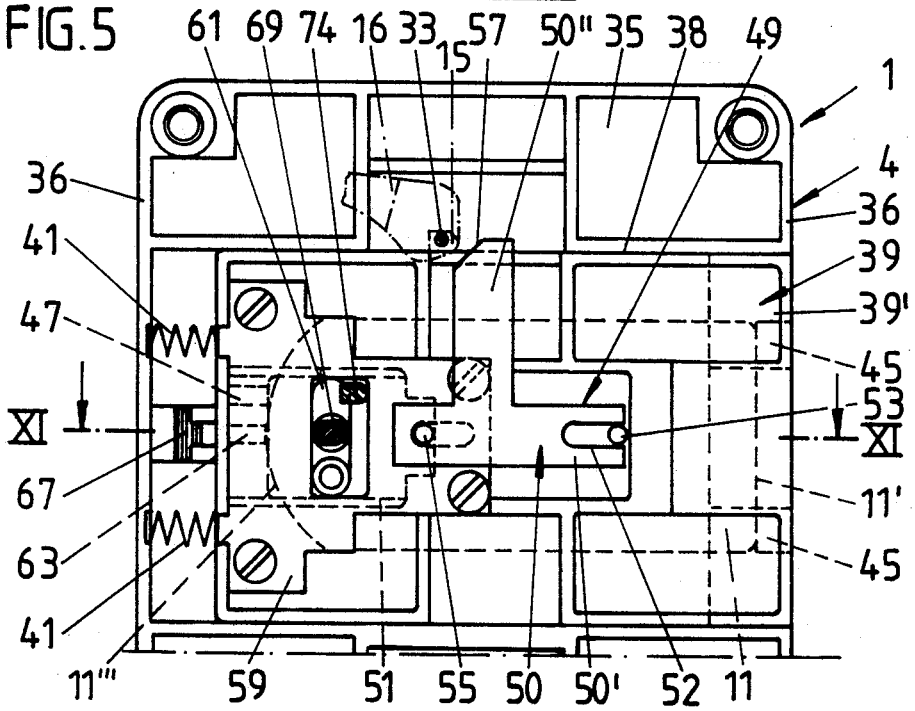
FIG. 5 is a view similar to that of FIG. 4, with the coded card inserted and the supplementary slide in its displaced position.
Figure 12:
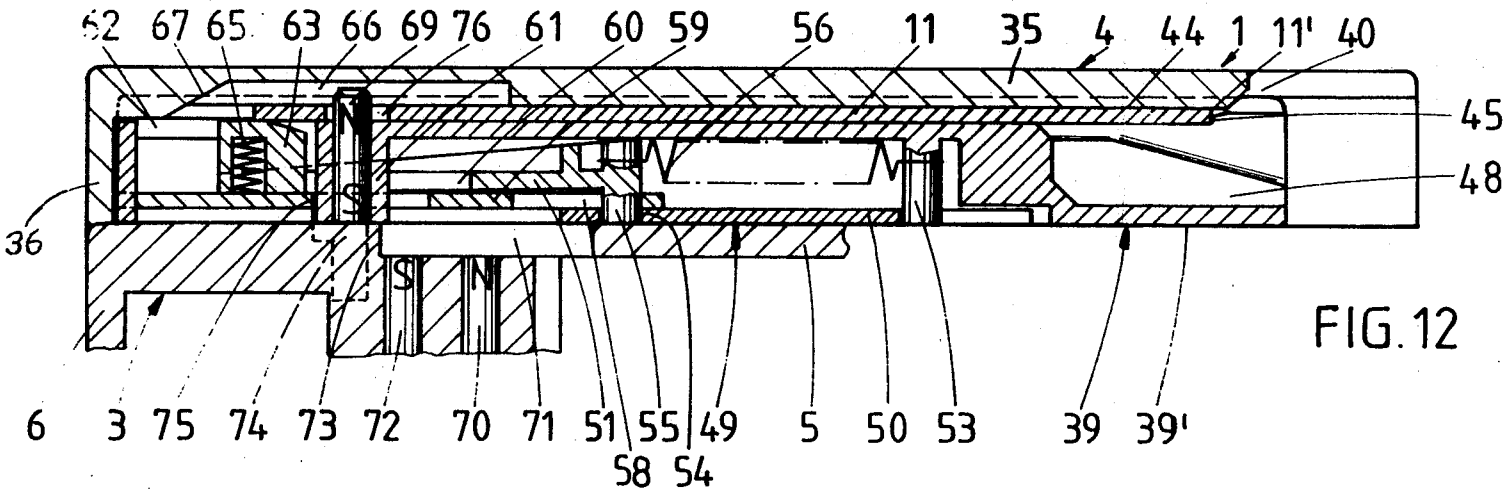
FIG. 12 is a cross-sectional view taken along line XII—XII of FIG. 6.

The mode of operation of the lock is explained as follows: Prior to the use of the safety deposit box or locker compartment, bolt 12 is in its non-locking position, door 2 is open and key 32 cannot be removed from the cylinder lock 30. To permit the use of the safety deposit box or compartment and subsequent locking of the latter, a coded card 11 having a hole 76 at its leading end is needed. Such card can be pushed or inserted into card insertion shaft 44 of slide 39 from the insertion end 39'—cf. FIGS. 1 and 10. As the coded card is inserted, leading edge 11 of the edge acts on cam 63 of supplementary slide 49, which is displaced against the spring load. During the final phase of insertion of card 11, the trailing end of such card runs over shoulders 45, so that thereafter, trailing edge 11' of the card is supported on shoulders 45. Thus, card 11 is now fixed on slide 39. As a result of the fact that supplementary slide 49 has been driven along, or carried along, control finger 50'' has been displaced from the position in FIG. 4 into the position according to FIG. 5, which means it is now within the direct proximity of driving pin 33 of the locking pawl 16. Using the key 32, the locking movement can be carried out, whereby bolt 12 is carried along into the locking position via crank arm 28. Driver 74 extending from bolt 12, after having travelled a short distance, engages the corresponding edge of window 75 of slide cover 59 and, in this way, causes slide 39 to be driven along in the locking direction. In the course of this action or operation, bevel 57 of control finger 50'' acts on driving pin 33 and thereby lifts locking tooth 15 from the path of movement of the shaped edges of locking recess 14 of bolt 12, so that the locking movement is not interfered with. Furthermore, during this locking movement, magnetic pin 69 scanning the card is carried or driven along. As soon as such pin has reached the zone of repelling magnet 72, pin 69 is displaced inwardly in the direction of front wall 35 of the lock, in the course of which displacement it penetrates card hole 76, which allows magnetic pin 69 to pass blocking edge 73. In the final phase of the locking operation, cam 63 acts on run-up bevel 67, causing rocker 51 to swivel. This displaces cam 63 completely from card insertion shaft 44, so that subsequently tension spring 56 moves supplementary slide 49 into the position according to FIG. 12. This is the prelocked position of bolt 12. Key 32 can now be removed from cylinder lock 30. FIG. 12 shows that thereafter trailing edge 11' of the card is disposed beneath front wall 35 of the lock in a hidden position, which is accomplished by the fact that slide 39 is driven or carried along. Card 11 cannot be removed with safety deposit box door 2 open and bolt 12 in its locking position.

By bringing bolt 12 into the locking position, the function of the locking repeat barrier has been released in that supplementary slide 49, as mentioned before, has assumed the position according to FIG. 12.

Figure 13:
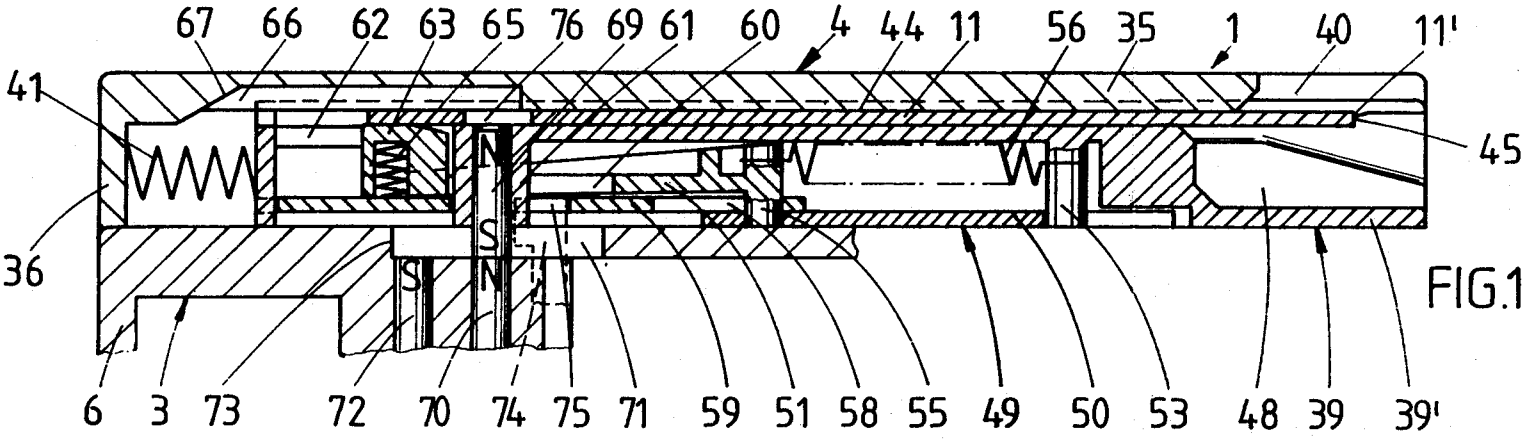
FIG. 13 is a cross-sectional view taken along line XIII—XIII of FIG. 8.

If bolt 12 is moved back into its non-lockilng position by means of key 32, the position according to FIGS. 8 and 13 is reached, in which trailing edge 11' of the card is disposed within the range of recess 40 of front wall 35 of the lock, and card 11 can be removed. However, if an attempt is made to again bring the bolt into its locking position from the position according to FIGS. 8 and 13, control finger 50'' is not capable of reaching with its bevel 57 driving pin 33 of locking pawl 16, so that locking tooth 15 is caused to drive into the locking position blocking the corresponding edge of blocking recess 14, preventing the bolt from being moved into its locking position. Accordingly, the user of the safety deposit box cannot completely move the bolt into the locking position in order to be subsequently able to remove the key, but is rather alerted to the fact that he has to remove the card from the card insertion shaft 44. If card 11 is inserted again, the bolt can be moved again into the locking position, and the safety deposit box can be used intermittently.

If a card with an erroneous coding is used, i.e., a card without a hole, or with a hole in the wrong place, cam 63 with supplementary slide 49 can be displaced by leading edge 11''' of the card; however, locking with the bolt is prevented by card-scanning magnetic pin 69, which, accordingly, cannot be moved by repelling magnet 72 into a position releasing blocking edge 73.

The coin release control for the locking function, which control is connected in parallel with the card release control, can be designed in a way such that a coin 10 is inserted, which then drops into the position according to FIG. 7, where it is supported on pin 23 and shoulder 24. As bolt 12 is being moved in the locking position, the edge of the coin lifts locking pawl 16 via locking tooth 15 into a release position, which permits locking the safety deposit box. In this case, too, repelling magnet 72 displaces card-scanning magnet 69 into the release position. The box may be locked in this way, for example, while the user is using a suitably coded card for other services offered on the public bathing premises. Once bolt 12 is later moved back into the non-locking position, coin 10 drops into the coin return shaft, from where it can be collected.

Instead of a perforated card 11 it is possible to use a card containing magnetic platelets embedded therein. In this case, the magnetic pin must be arranged accordingly.

While only a single embodiment of the present invention has been shown and described, it will be obvious that many changes and modifications may be made there unto without departing from the spirit and scope of the invention.

What is claimed is:

1. In a lock with a locking function of a bolt which is released by the insertion of a coded, scanned card, and carried out by means of a key, in particular for use in safety deposit box compartments of public swimming pools or the like, the lock having a casing with an outwardly open card insertion shaft, and a slide which is displaceable by the leading edge of the card during insertion, said slide being biased away from the direction of card insertion and having a control finger for lifting a locking pawl associated with the bolt, the improvement comprising:

said card insertion shaft being arranged on a second slide which is displaceable by the locking movement of the bolt, said first slide having a cam and being supported by said second slide, when said second slide is displaced forwardly from its stop position said cam is controlled on the leading edge of the card, whereby said first slide releases the function of the bolt locking repeat barrier.

2. The lock as defined in claim 1, wherein said locking pawl is controllable also into the release position by the edge of a coin inserted in the lock.

3. The lock as defined in claim 1, wherein said second slide is spring-loaded against its locking movement.

4. The lock as defined in claim 3, wherein said second slide supports at least one card-scanning magnetic pin, said magnetic pin being displaceable crosswise relative to the direction of displacement of said first slide.

5. The lock as defined in claim 1, wherein said cam is seated on the free end of a rocker which is supported in said second slide and spring-loaded by a pressure spring in the direction of the card insertion shaft.

6. The lock as defined in claim 1, wherein said card insertion shaft is arranged on a second slide displaceable together with the locking movement of the bolt, in a way such that the trailing edge of the card is in a hidden position when the bolt is in the locking position.

7. The lock as defined in claim 6, wherein said second slide has a pocket for positively supporting the card within the zone of all of its edges.

8. The lock as defined in claim 7, wherein the support on the back edge of the card comprises lateral shoulders running over such edge when the card is inserted.

9. The lock as defined in claim 6, wherein when said second slide is in its basic position, the end of the slide on the insertion side is disposed aligned with a recess of the front wall of the lock.

10. The lock as defined in claim 9, which further includes a coin release control for the locking function, said coin release control being connected in parallel with the card release control.

* * * * *

UNITED STATES PATENT AND TRADEMARK OFFICE

CERTIFICATE OF CORRECTION

PATENT NO. : 4,918,957

DATED : April 24, 1990

INVENTOR(S) : Armin EISERMANN

It is certified that error appears in the above-identified patent and that said Letters Patent is hereby corrected as shown below:

Cover page, column 1, immediately preceding item [21], add the following name and address of the assignee, including the appropriate PTO item number:

ITEM [73] Schulte-Schlagbaum Aktiengesellschaft
Nevigeser Strasse 100-110
D-5620 Velbert 1, West Germany

Signed and Sealed this

Thirty-first Day of March, 1992

*Attest:*

HARRY F. MANBECK, JR.

*Attesting Officer*

*Commissioner of Patents and Trademarks*